US006880637B2

(12) United States Patent
Myers, Jr. et al.

(10) Patent No.: US 6,880,637 B2
(45) **Date of Patent: *Apr. 19, 2005**

(54) FULL BORE AUTOMATIC GUN RELEASE MODULE

(75) Inventors: William D. Myers, Jr., Spring, TX (US); Colby W. Ross, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/439,504

(22) Filed: May 16, 2003

(65) Prior Publication Data

US 2003/0192696 A1 Oct. 16, 2003

Related U.S. Application Data

(63) Continuation-in-part of application No. 10/002,791, filed on Nov. 15, 2001, now Pat. No. 6,591,912.

(60) Provisional application No. 60/248,810, filed on Nov. 15, 2000.

(51) Int. Cl.[7] ..... E21B 43/117; E21B 17/06

(52) U.S. Cl. ..... 166/297; 166/55.1; 166/242.7; 166/377

(58) Field of Search ..... 166/212, 297, 166/55.1, 377, 242.7; 175/4.52

(56) References Cited

U.S. PATENT DOCUMENTS

| | | | | | |
|---|---|---|---|---|---|
| 3,746,093 | A | | 7/1973 | Mullins | 166/217 |
| 4,429,741 | A | | 2/1984 | Hyland | 166/63 |
| 4,526,233 | A | | 7/1985 | Stout | 166/377 |
| 4,576,236 | A | * | 3/1986 | Stout et al. | 166/386 |
| 4,582,135 | A | | 4/1986 | Akkerman | 166/134 |
| 4,611,660 | A | | 9/1986 | Stout et al. | 166/297 |
| 4,648,445 | A | | 3/1987 | Caskey | 166/98 |
| 4,756,363 | A | | 7/1988 | Lanmon, II et al. | 166/55.1 |
| 4,771,827 | A | | 9/1988 | Barker et al. | 166/55.1 |
| 4,776,393 | A | | 10/1988 | Forehand et al. | 166/55.1 |
| 4,790,383 | A | | 12/1988 | Savage et al. | 166/297 |
| 4,815,540 | A | | 3/1989 | Wallbillich, III | 166/377 |
| 5,156,213 | A | | 10/1992 | George et al. | 166/297 |
| 5,293,940 | A | | 3/1994 | Hromas et al. | 166/297 |
| 5,361,912 | A | * | 11/1994 | Krieg et al. | 209/524 |
| 5,370,186 | A | | 12/1994 | Ireland | 166/297 |
| 5,423,382 | A | | 6/1995 | Barton et al. | 166/297 |
| 5,429,192 | A | | 7/1995 | Huber et al. | 166/297 |
| 5,509,481 | A | | 4/1996 | Huber et al. | 166/297 |
| 6,098,716 | A | | 8/2000 | Hromas et al. | 166/377 |
| 6,148,916 | A | | 11/2000 | Sampson et al. | 166/297 |
| 6,286,598 | B1 | * | 9/2001 | van Petegem et al. | 166/297 |
| 6,591,912 | B1 | * | 7/2003 | Ross et al. | 166/297 |

* cited by examiner

*Primary Examiner*—Hoang Dang
(74) *Attorney, Agent, or Firm*—Madan, Mossman & Sriram, P.C.

(57) ABSTRACT

A well completion procedure and apparatus comprises a first assembly that includes production tubing combined with a production packer and an internal bore latching profile. A second assembly comprises an explosive perforating gun secured to a latching mechanism. The perforating gun and latching mechanism are dimensioned to freely traverse the flow bore of the production tubing for downhole retrieval and return after the packer is set. The latching mechanism may be released by discharge of the gun.

15 Claims, 9 Drawing Sheets

FULL BORE AUTOMATIC GUN RELEASE MODULE

CROSS-REFERENCE TO RELATED APPLICATIONS

This application is a Continuation-In-Part of U.S. patent application Ser. No. 10/002,791 filed Nov. 15, 2001 now U.S. Pat. No. 6,591,912. Said application Ser. No. 10/002,791 claims the filing priority date of Nov. 15, 2000 based upon U.S. Provisional Application Ser. No. 60/248,810.

BACKGROUND OF THE INVENTION

1. Field of the Invention

The present invention relates to the art of well drilling and earth boring. More particularly, the invention relates to methods and apparatus for perforating wellbore casing, casing liner and/or fracturing well production zones.

2. Description of Related Art

After the actual drilling of a borehole into the earth, the borehole shaft is often prepared for long term fluid production by a series of steps and procedures that are collectively characterized by the art as "completion." Among these numerous procedures is the process of setting a casing, usually steel, within the borehole to line the shaft wall with a stable, permanent barrier. This casement is often secured by cement that is pumped into the annulus between the outside diameter of the casing and the inside diameter of the raw shaft wall.

While the casing stabilizes the shaft wall, it also seals the fluids within the earth strata that have been penetrated by the borehole from flowing into the borehole. The borehole inflow of some of the fluids is the desired objective of making the borehole in the first place. To selectively open the casing to such fluid flow, the casing wall is often penetrated in the region of a fluid production zone by shaped charge explosives or "bullets". In the case of shaped charge explosives, the gaseous product of decomposing explosive material is focused linearly as a high temperature plasma to burn a perforation through the casing wall. Numerous of these charges are loaded into tubular "guns", usually in a helical pattern along and around the gun tube axis for positioning within the wellbore at the desired location. The line of discharge from the gun is radial from the gun tube axis.

By traditional prior art procedure, the tubular gun may be releasably secured to the end of a wireline or coiled tube for running into the well. When the gun has been located at the desired depth, the gun is secured to the casing or casing liner bore wall by radially expandable slips, for example. This setting or anchoring procedure is essential to substantially center the gun within the casing bore for radially uniform penetration. In some cases, the slips are releasable from the casing to facilitate removal of the gun assembly from the casing bore in the event that need arises: either before of after firing.

Subsequent to the prior art perforation procedure, the production tubing is run into the well and set. Often, setting of the production tubing also includes a production packer around the production tubing to seal the well annulus around the tubing above the perforation zone.

The downhole environment of a deep earth boring is frequently hostile to the extreme. The borehole is usually filled with a mixture of drilling fluids, water and crude petroleum. At such depths, the bottom hole pressures may be in the order of tens of thousands of pounds per square inch and at hundreds of degrees Celsius temperature. Consequently, by the time the perforating gun arrives at the desired perforation location, the ignition system, the explosives or the propellant charges are sometimes compromised to the extent that discharge fails to occur on command. In anticipation of such contingencies, provision is often made for unrelated alternative firing systems. If all else fails, the defective gun must be withdrawn from the well and repaired or replaced and returned.

As a further consideration, many of the well completion steps require specific tools that are operatively secured within the length of a pipe or tubing work string and deposited into the wellbore from the surface. Placement of a completion tool on downhole location may require many hours of extremely expensive rig time and skilled labor. The full cycle of downhole tool placement and return is termed in the art as "a trip."

At the present state of art, many of the necessary well completion tools are assembled collectively on a single work string and run into the wellbore together for the purpose of accomplishing as many of the several completion steps in as few "trips" as possible. There could be many advantages, therefore, for including the perforation gun at the end of a completion tube having a well production packer set above the gun prior to discharge. In a single trip, the well could be perforated, fractured, packed and produced. On the negative side, however, should the gun misfire, it would be necessary to disengage the production packer and withdraw the entire work string to repair or replace the perforation gun.

Comparatively, tools and instruments suspended from drum reeled "wirelines" are run into and out of a wellbore quickly and efficiently. There are advantages, therefore, in a well completion procedure that could position, secure, remove and/or replace a perforation gun or other such tool entirely by wireline. On the other hand, state-of-the-art wireline perforation is substantially a single purpose operation. The well is first perforated and, subsequently, the production packer is set.

Some completion assemblies connect the gun to the work string in such a manner that releases the spent gun tube to free fall further down the wellbore below the perforated production zone. In some cases, this gun release function may be desirable. In other cases, especially when additional drilling may be contemplated, the spent gun becomes downhole "junk" and must be extracted by a fishing operation.

It is, therefore, an object of the present invention to provide a means and method for securing a perforating gun to the end of a completion or production tube for alternative operational modes. In one mode, the gun may automatically disconnect from the work string when the gun is discharged and free fall from the perforation zone. In another operational mode, the gun may be tethered to a wireline and withdrawn from the well after discharge.

Another object of the invention is provision of a perforation gun assembly that may be lowered into a well along a work string tube bore at the end of a wire line, secured to the tube bore at the desired position and discharged. In the event of malfunction, the gun may, by wireline, be disconnected from the work string tube, withdrawn for repair, and returned by wireline.

SUMMARY OF THE INVENTION

A generalized description of the invention includes a perforation gun connection module, which is one element of a connecting linkage between a perforating gun and a string of production tubing or pipe. The perforating gun is firmly secured, by means of pipe threads, for example, to the lower end of the connection module. The lower end of the connection module, however, comprises an axially shifted trigger section that is temporarily secured for well run-in at an upper assembly position within the connection module by means of a first or lower set of latching dogs.

The upper end of the connection module is selectively secured to the tubing sub by means of a second or upper set of latching dogs. The tubing sub is provided with an internal connection profile into which connection module latching dogs may be engaged. The upper end of the tubing sub is traditionally secured, by pipe threads for example, to the lower end of a supporting tube string.

The gun outside diameter and that of the associated gun connection module is coordinated to the inside bore diameter of the production tubing whereby the gun and connection module may be drawn in either direction along the length of the production tubing bore.

Above the tubing connection sub is a completion packer joint. When deployed downhole, the completion packer joint secures and pressure seals the assembly to the wellbore.

A first or lower set of latching dogs temporarily secure a lower trigger section of the connection module to an upper section of the connection module. The perforating gun is connected directly to the trigger section. When the gun discharges, detonation gases generate a pressure surge within the bore of the perforating gun which are channeled to act upon one annular end face of a sleeve piston. The sleeve piston is thereby axially displaced by a resulting pressure differential to align a reduced radius release perimeter along the piston surface under the first dog set. When the release perimeter is axially aligned with the first latching dogs, the dogs radially retract from a position of meshed engagement with a circumferential ledge that is formed around the inside perimeter of a cylindrical counterbore in the connection module socket cylinder. Upon radial retraction of the first latching dogs, the spent gun is free to axially slide along the connection module socket cylinder for a limited distance.

The second or upper latching dog set is expanded into a circumferential latch channel formed around the inside bore of the work string connection sub. Radially shifting latch pins are caged by a setting piston and externally meshed with a latching cone. Internally, the latch pins are supported by a surface profiled latch tube. A connective relationship between the tubing connection sub and the upper latching dogs is maintained by shear pins and screws through the connection sub and the upper latch setting piston. Preferably, the gun and connection module are originally assembled in a fabrication shop and delivered to the well site as a pre-assembled unit. On the rig floor, for example, the assembled gun and connection module unit is secured by mating threads to the connection sub that is independently secured to the lower distal end of the production tubing When the spent gun shifts downwardly, the profiled upper latch tube is pulled down to shear the respective retaining pin and remove the radial support structure under the upper latch pins. Without interior support, the upper latch pins retract radially inward to release the upper connecting dogs from the internal latching channel within the connecting sub. When the upper connecting dogs retract from the internal latching channel, the connection module and spent perforating gun are free to fall away from the end of the connector sub.

In an alternative operational mode, such as when the gun fails to discharge, the upper latching dogs may be retracted by a wireline pull on the upper latch profile tube. This releases the gun and connection module assembly as a unit from the work string tube. At any time, the unit may be drawn out of the wellbore at the end of the wireline along the work string internal bore, replaced or repaired and returned.

BRIEF DESCRIPTION OF THE DRAWING

For a thorough understanding of the present invention, reference is made to the following detailed description of the preferred embodiments, taken in conjunction with the accompanying drawings in which like reference characters designate like or similar elements throughout the several figures of the drawing. Briefly.

DESCRIPTION OF THE PREFERRED EMBODIMENTS

CONSTRUCTION AND ASSEMBLY

Figure 1:
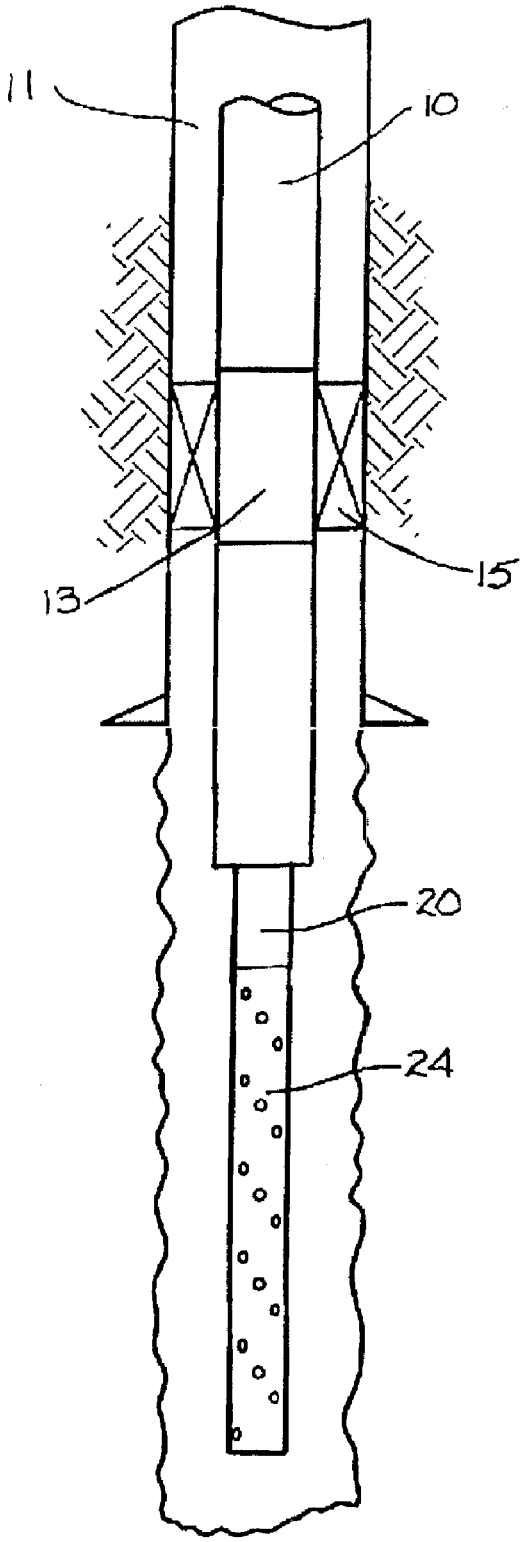
FIG. 1 is a downhole schematic of the invention.

The invention is shown schematically by FIG. 1 to include production tubing 10 suspended within a wellbore 11. The production tubing may be secured to the wellbore wall by anchoring slip elements of a production packer joint 13. An annular space between the packer joint outer perimeter and the inside wellbore wall is bridged by expansible packer seal elements 15. This bridge across the wellbore annular space isolates the well production zone below the packer joint 13 from the wellbore space above the packer joint 13.

Although the invention operating environment may include substantially horizontal wellbore orientation, references herein to "upper" and "lower" are generally related to the wellbore surface direction. Accordingly, the left end of the FIGS. 2 through 10 illustrations normally represents the "upper" end direction of the assembly. Descriptive references to "up" and "down" hereafter will be consistent with this orientation.

Below the packer joint 13 is a tubing connection sub 30 that connectively links the perforating gun connection module 20 with the production tubing 10. The upper end of the perforating gun 24 is secured to the lower end of the connection module 20.

FIGS. 2 through 7 show the invention as a quarter-sectioned assembly within a half-sectioned connection sub 30. Although the perforating gun 24 is not, per se, illustrated by FIGS. 2–10, the upper end of the gun is attached by screw threads to the trigger section 53 of the connection module 20. The gun connection module 20 structurally links the tube connection sub 30 with the perforating gun assembly unit 24.

Notably, the tubing connection sub 30 provides a latch channel 32 extending around the inside bore of the sub. Preferably, the connection sub 30 may be secured in a traditional manner such as by pipe threads, to a tubing extension below the packer joint 13.

As an initial description of relative dimensions, it will be noted that the gun connection module 20 and perforating gun unit 24 preferably are cross-sectionally dimensioned to pass axially along the internal bores of the connection sub 30, the packer joint 13 and the production tubing 10 entirely to the surface.

Referring to FIGS. 2 through 10, the gun release triggering mechanism 53 of the connection module 20 comprises a tubular case wall 21 having a plurality of latch dog windows 48 around the lower perimeter of the case. At the upper end of the outer case wall 21, the inner bore is formed by internal profiles 16 to connect with a setting tool 17 (see FIG. 7). The setting tool 17 is typically run in by wireline, but may also be run in using coiled tubing or conventional tubing.

Figure 10:
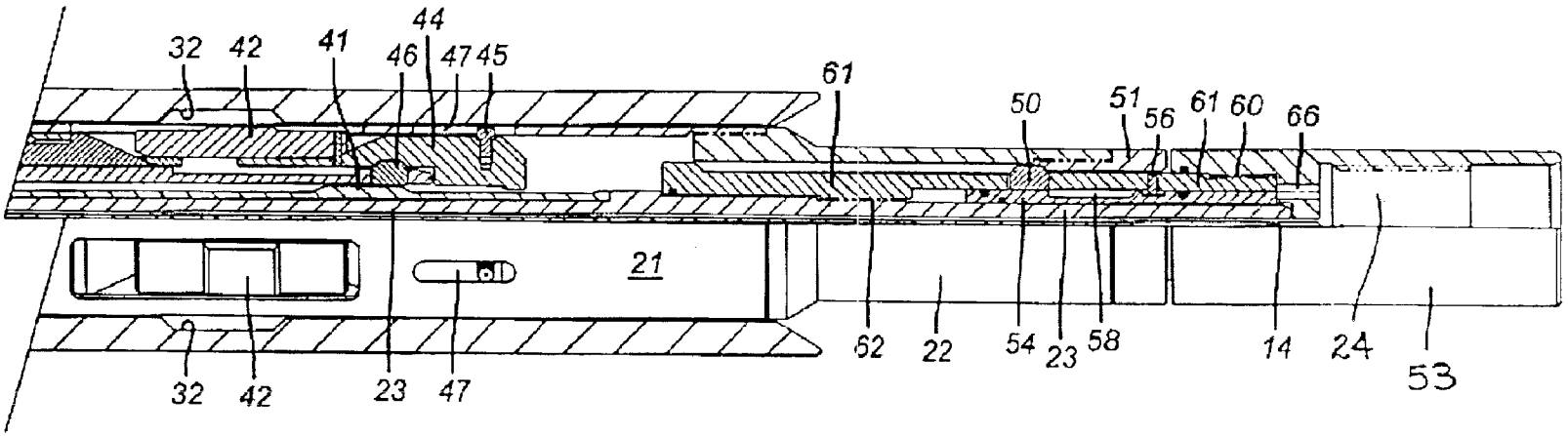
FIG. 10 is an enlarged view of the lower latching assembly.

The FIG. 10 enlargement of the connection module 20 illustrates the lower end of the case wall 21 as including a socket cylinder 22. The internal bore of the socket cylinder 22 is threaded at its lower end to receive a latch collar 51. The latch collar 51 profiles a structural support ledge for lower latching dogs 50.

The gun assembly unit 24 is secured by assembly thread 60 to a caging sleeve 61. The caging sleeve 61 is secured by assembly thread 62 to a stinger element 23. A concentric cylinder lap between the lower end of the stinger element 23 and the caging sleeve 61 forms an annular cylinder space within which a lower latching piston 54 translates. A circumferential channel 58 in the outer perimeter of the lower latching piston 54 is sufficiently wide and deep to accommodate radial extraction of the lower latching dogs 50 from a radial engagement with the latch collar 51 when the channel 58 is axially aligned with the base of the latching dogs 50. Under in-running conditions of gun placement, the latching dogs 50 are laterally and circumferentially confined within windows in the caging sleeve 61. Radially, the latching dogs 50 are confined to the expanded position by a shoulder portion of the latching piston 54 when the latching piston is appropriately aligned. The latching piston shoulder portion has a greater diameter than the root diameter of channel 58. In-running, the latching piston 54 support location for the radially expanded position of the latching dogs 50 is secured by shear pins 56.

The upper end of the stinger element 23 is secured to an interventionless firing head (IFH) 27. A detonation cord channel 14 extends from the IFH along the length of the stinger 23 to the gun 24 detonator not shown. Detonation cord ignition occurs in response to pressure pulse signals transmitted along the well fluid from the surface. The detonation cord channel 14 is vented at 66 against the lower ends of the latch piston 54. When the perforating gun is discharged, combustion gas pressure is channeled through the vents 66 against the lower edge of the latch piston 54. This combustion gas pressure displaces the piston 54 to align the channel 58 under the lower latching dogs 50 and allow retraction of the dogs 50 from a meshed engagement with the socket cylinder latch collar 52. When the dogs 50 are retracted from the latch collar 52, weight of the gun unit 24 axially pulls the stinger 23 down along the socket cylinder bore until the lower shoulder 31 of the IFH engages the annular step of a spacing collar 35.

The spacing collar 35 joins a secondary release sleeve 25 to an upper latch profile tube 40. The latch profile tube 40 has an axially sliding fit over the stinger tube 23. The external surface of the latch tube 40 includes a profiled latching zone 41 having a greater outside diameter than the adjacent tube surface. The internal bore of the release sleeve 25 has a sliding fit over the IFH and a wireline latching profile 18 near its upper end. Proximate of the spacing collar 35, the external surface of the release sleeve is channeled axially by a keyway 26. A retaining pin 28 set in the outer case wall 21 is projected into the keyway 26 to limit axial displacement of the release sleeve 25 without shearing the pin 28.

Figure 8:
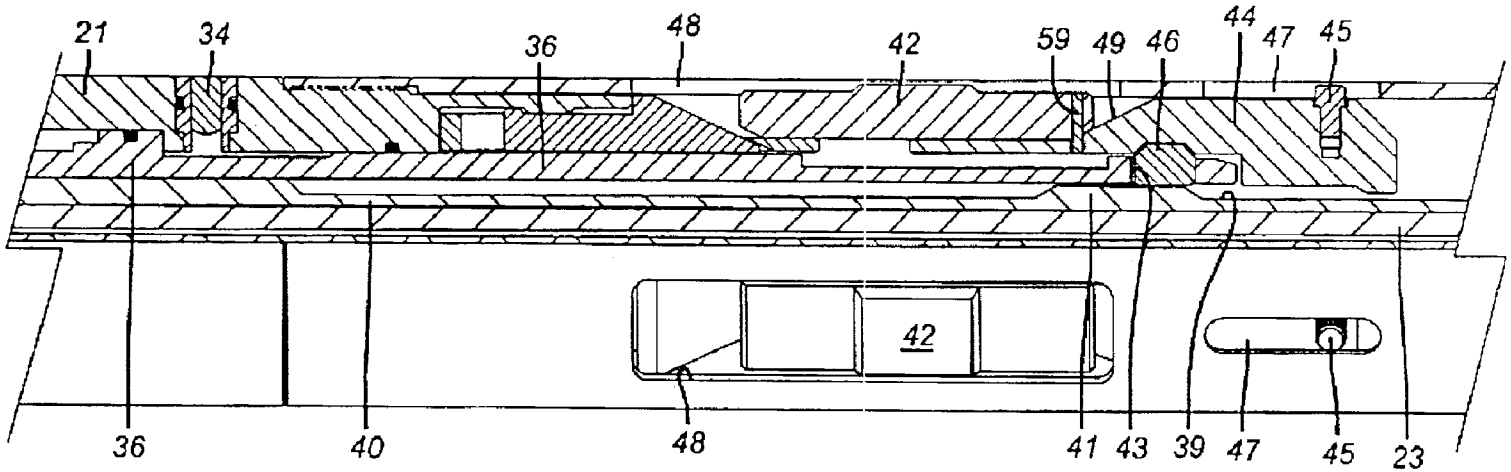
FIG. 8 is an enlarged view of the upper latching assembly within the detail delineation of FIG. 1.
Figure 9:
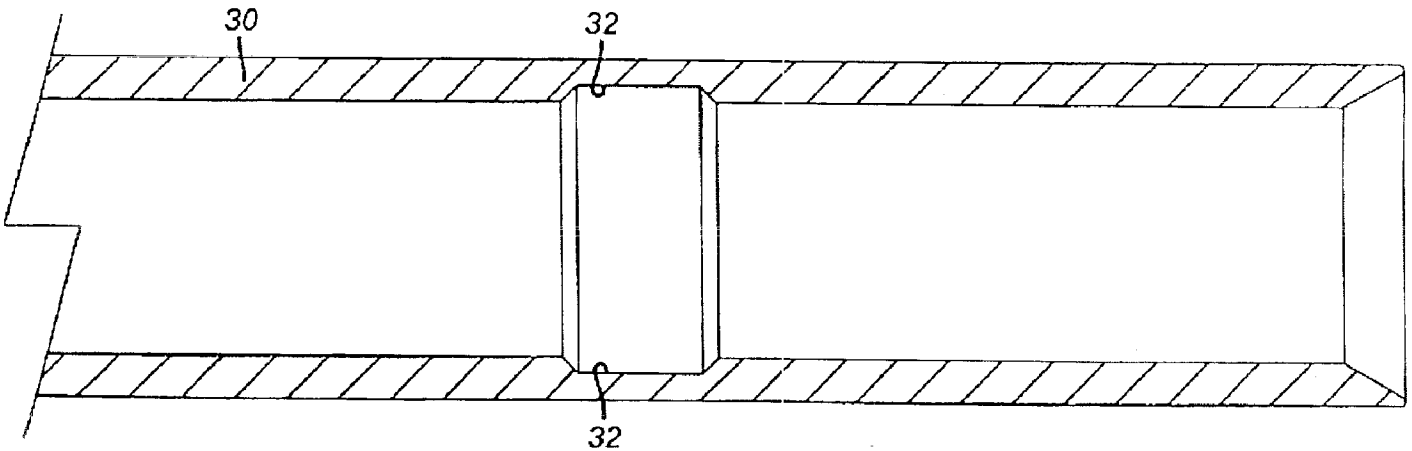
FIG. 9 is a detailed half section of the tubing connection module.

As best illustrated by the enlargement of FIG. 8, the latching zone 41 of the latch profile tube 40 cooperates with upper latch pins 46 to secure an axially firm connection with an upper latch cone 44. Axial displacement of the latch cone 44 is limited by one or more guide pins 45 confined within an axially slotted guide window 47. The upper latch pins 46 are laterally confined within caging windows 43 in an upper setting piston 36. The axial position of the setting piston is secured to the outer case 21 by shear pins 38 for run-in. The setting piston 36 is responsive to wellbore pressure admitted by the opening of a calibrated rupture disc 34. When the wellbore pressure is sufficient, rupture of the disc 34 allows a fluid pressure bias to bear upon the piston 36. Nevertheless, the piston 36 may remain immobile due to the shear strength of the pins 38. However, as the tool continues its descent into a well, the hydrostatic pressure increases proportionally. When the pressure bias on the piston 36 is sufficient, retention pins 38 are sheared thereby allowing the wellbore pressure bias to drive the piston 36 against the latch pins 46. Since the latch pins 46 have a meshed engagement with the latch cone 44, the piston 36 force is translated by the latch pins 46 to the latch cone 44 and finally, to the shear pins 59.

Shear pins 59 secure the relative run-in alignment positions between the latch cone 44 and the upper latching dogs 42. When the pins 59 fail under the wellbore pressure generated force, the latch cone 44 slip face 49 is axially pulled under the upper latching dogs 42 by the setting piston 36 to radially translate the latching dogs 42 out through the latch dog windows 48 and against the inside bore wall of the production tubing 10. The latching dogs 42 may drag against the inside bore wall as the assembly descends into the well until the upper latching dogs 42 align with the latch channel 32 whereupon the latching dogs 42 engage the channel and anchor the assembly to the production tubing 10 at this precise point of operation.

The stinger 23 is also connected to an electronic firing head (IFH) 29. The IFH is operative to ignite the detonation cord 14 in response to sonic signals transmitted along the well fluid from the surface. Conveniently, the electronic firing head 29 may be removed and replaced from a downhole location by an appropriate wireline tool. If desired, the IFH may be replaced by a more traditional percussion head for igniting the detonation cord 14 by such means as a falling rod that impacts a detonation hammer.

Operation

Figure 2:
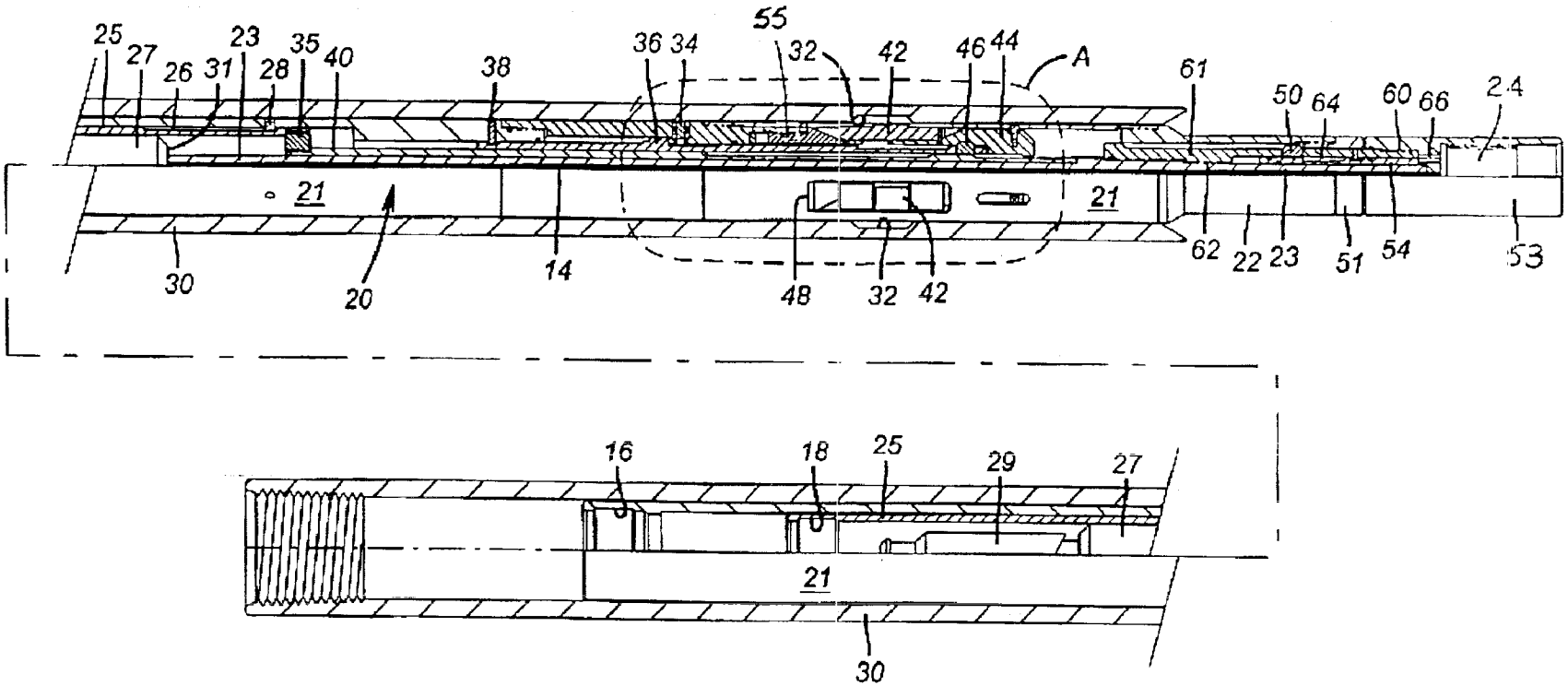
FIG. 2 is a quarter section view of the invention assembly set for in-running down a work string tube at the end of a wireline.

With respect to FIG. 2, the gun assembly unit 24 may be unitized with the gun connection module 20 and the tubing connection sub 30 at a convenient remote location such as a shop or manufacturing facility and transported as a unit to the utility well site. To do this, the calibrated rupture disc 34 is removed and replaced by a temporary pressure plug (not shown). The module 20 is attached to the tubing connection sub 30 by preloading the latching mechanism with fluid under a shop pressure so that the latching mechanism remains secured. The upper latching dogs 42 are aligned with the latch channel 32, and a hydraulic hose (not shown) is operably secured to the temporary pressure plug to provide a sufficient hydraulic fluid pressure to bear upon piston 36 to that the latching dogs 42 can be engaged.

The upper end of the tubing connection sub 30 may be easily secured to the bottom end of the production tubing 10 on a rig floor while the tubing is suspended from the derrick crown in the same manner as connecting a bit or other well tool.

When the gun assembly unit 24 is secured to the connection module 20, the lower latching dogs 50 are extended radially to engage the end of the lower latching collar 51. This radially extended position is temporarily secured by the subjacent support of the cylindrical surface profile of the lower latch piston 54. This position of the axially translated lower latch piston is secured by one or more shear pins 56. As the assembly is lowered into the well, the weight of the gun assembly unit is directly carried by the latching dogs 50 bearing upon the latching collar 51.

Figure 3:
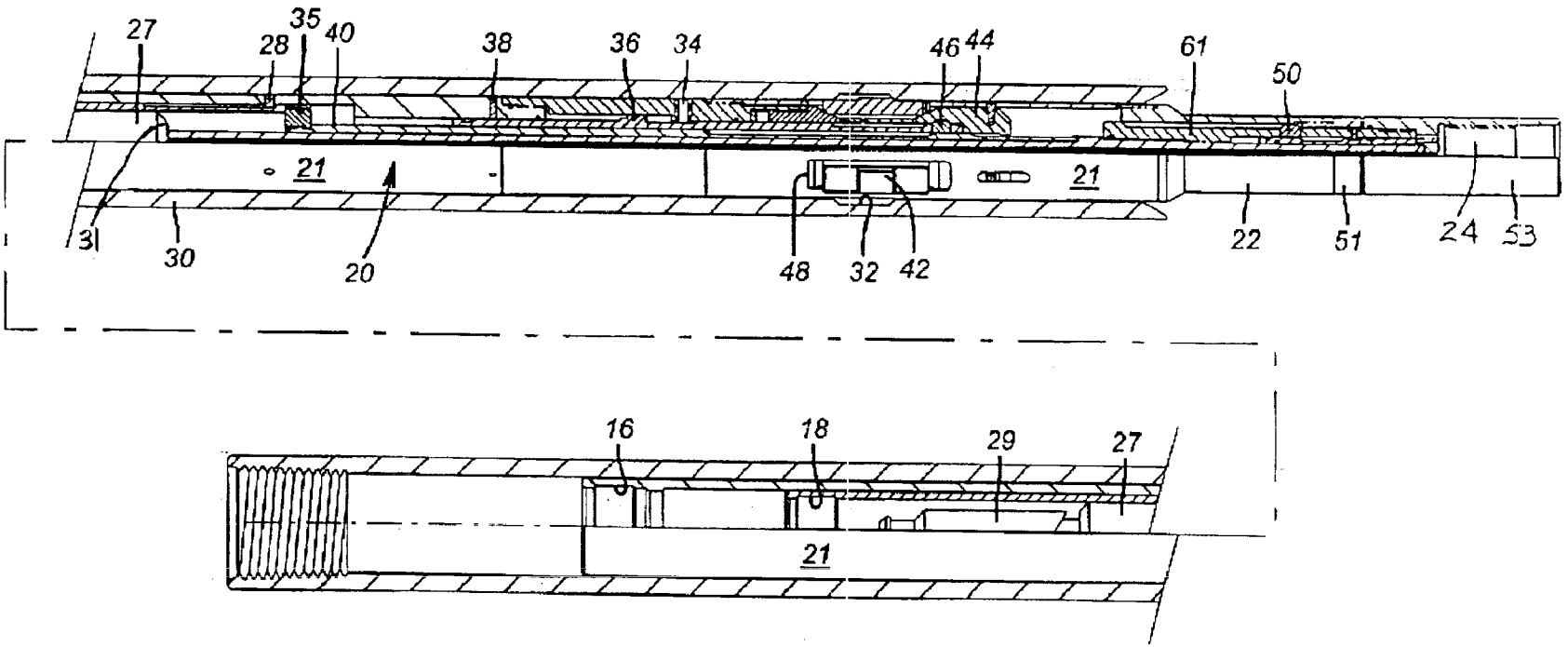
FIG. 3 is the invention assembly in a set configuration of the upper latching dogs.

The weight of the gun assembly and the connection module 20 is transferred to the production tubing 10 by the upper latching dogs 42 in meshed engagement with the latching channel 32 of the tubing connection sub 30 as shown by FIG. 3. The latching dogs 42 are confined between opposing ram faces respective to the upper latch cone 44 and the fixed base cone 55. Upper latch pins 46 secure the axially mobile position of the upper latch cone 44

In this disposition, the gun assembly is lowered into the well down to the bottom end of the production tubing string 10 and positioned for perforation.

Upon discharge of the perforating gun 24, combustion gas produced by the decomposing explosive is channeled through conduits 66 against the end face of the latch piston 54 to translate the reduced diameter channel zone 58 of the latch piston surface into radial alignment with the lower latching dogs 50. This change in radial support under the lower latching dogs 50 permits radial contraction of the latching dogs 50 inside of the inner bore of the latch collar 51. Release of the latch dog bearing on the latch collar 51 allows the gun weight to axially shift the gun 24 and stinger 23 relative to the connection module 20.

Figure 4:
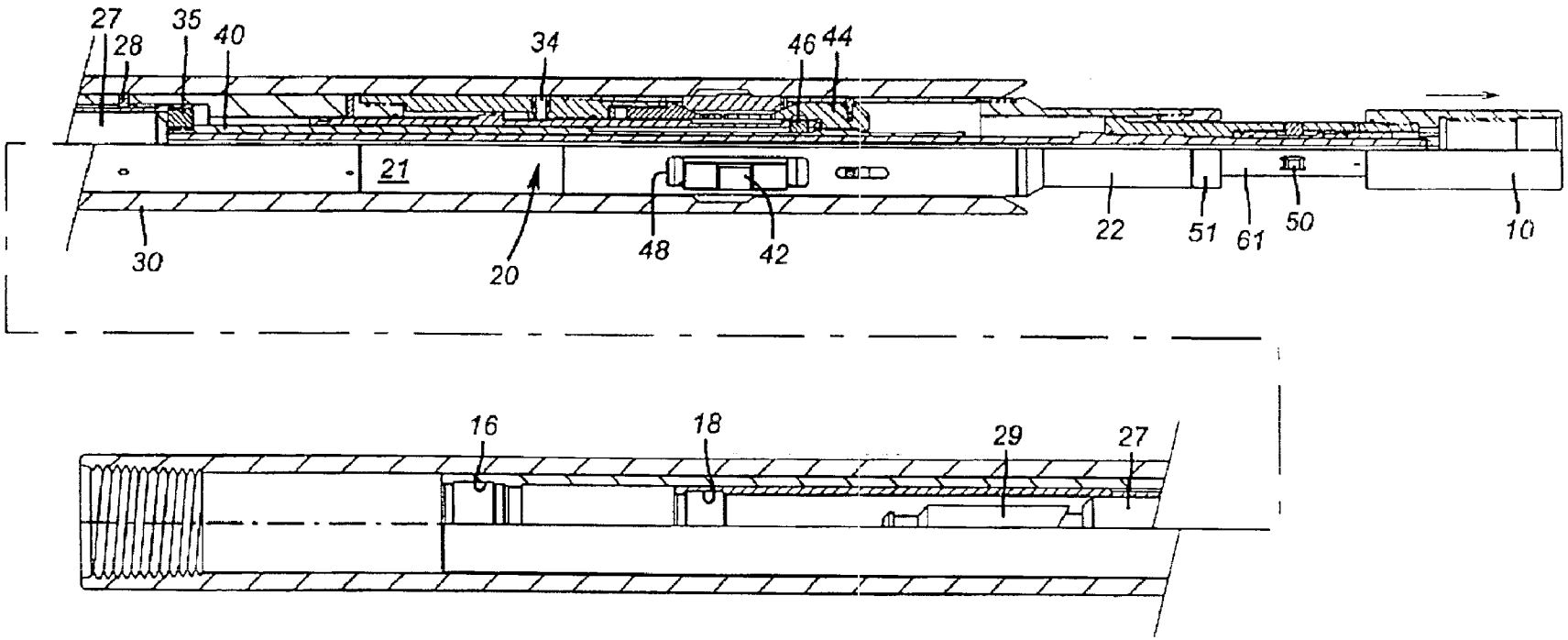
FIG. 4 is the invention assembly configured to the release of the lower latching dogs.

This axial shift of the stinger 23 draws the lower shoulder 31 of the IFH into engagement with the spacing collar 35 as illustrated by FIG. 4.

Figure 5:
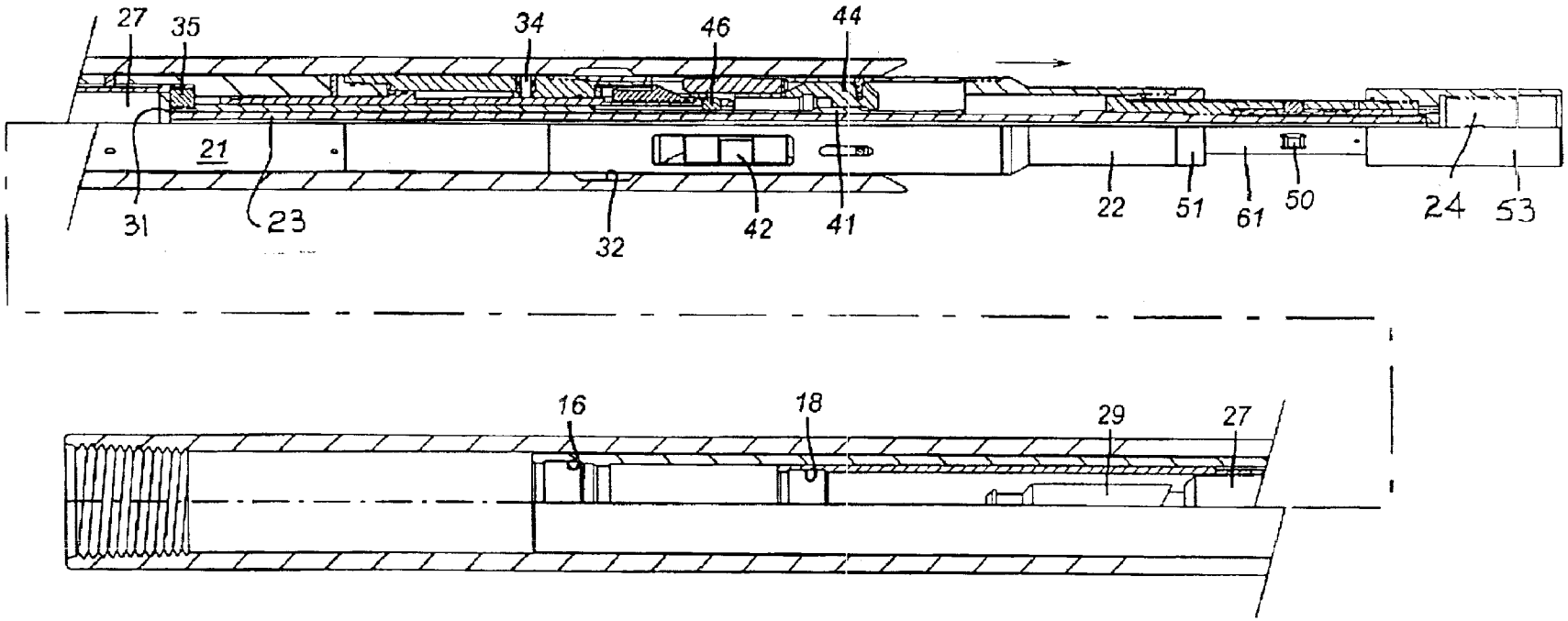
FIG. 5 is the invention assembly configured to the release of the upper latching dogs.

As a further consequence of the axial shift within the connection module 20, the gun weight 24, applied by the IFH shoulder 31 against the spacing collar 35, translates the stinger latching profile 41 from subjacent support of the upper latch pins 46. As illustrated by FIG. 5, loss of subjacent support by the latching profile 41 allows the upper latch pin 46 to withdraw from engagement with the upper latch cone 44. Without the latch pin 46 engagement, the latch cone 44 is allowed to translate axially from support of the upper latching dog 42. Retraction of the latching dog 42 from the completion tube latching channel 32 resultantly releases the gun 24 and connection module 20 from the connection sub 30.

Unless a wireline is connected, the assembly is now free to fall from the production tubing bore. If the assembly is wireline connected to the surface, the spent gun assembly may alternatively be removed along the production tubing bore to the surface.

Figure 6:
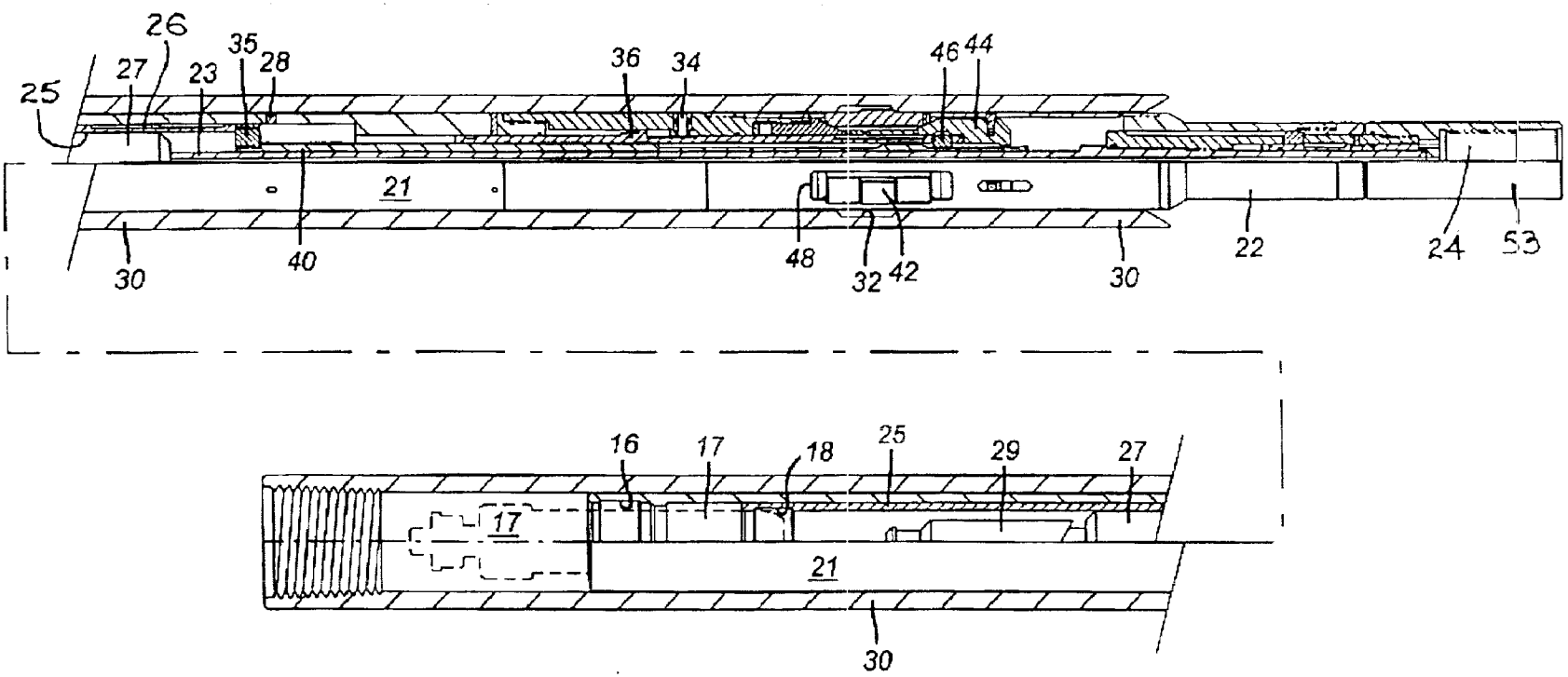
FIG. 6 is the invention assembly configured to the first step of the wireline release operational mode.
Figure 7:
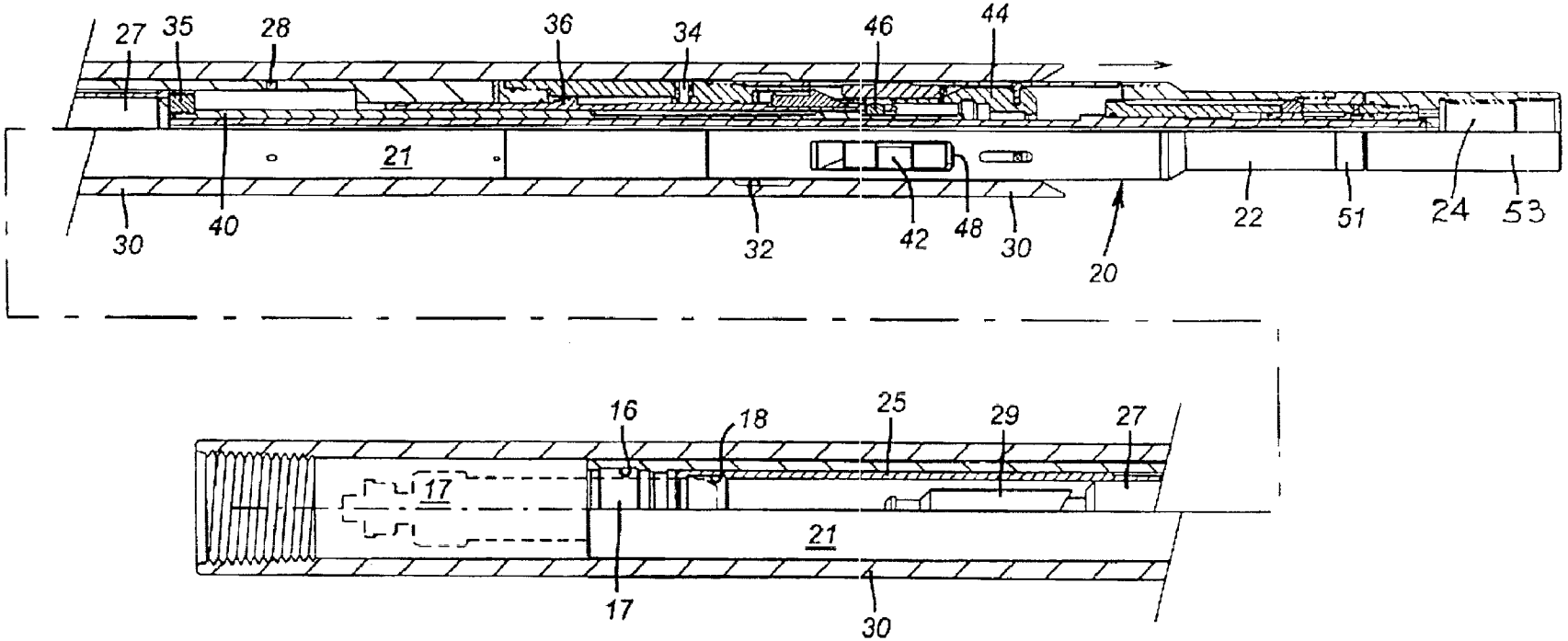
FIG. 7 is the invention assembly configured to the second step of the wireline release operational mode.

The manual mode for mechanically disconnecting and removing a gun and connection module assembly from a connection sub tube is illustrated by FIGS. 6 and 7. With respect to FIG. 6, a running tool 17 is aligned in the tool bore and secured to the release sleeve 25 by the connection profile 18.

Tension is drawn on the running tool 17 by manipulation of the wireline, coiled tubing or other system used to suspend the running tool 17 within the wellbore, in order to axially translate the sleeve 25 toward the surface direction. Uphole translation of the release sleeve 25 is normally limited by the meshed cooperation of the shear pins 28 and key slot 26. However, with the upper latch dogs 42 meshed with the completion tube latch channel 32, sufficient tension may be drawn on the release sleeve 25 to shear the pins 28 and displace the latch pin support profile 41 portion of the integral latch profile tube 40 from support alignment with the upper latch pin 46. Retraction of the latch pin 46 releases the latch cone 44 from support of the latch dogs 42. As previously described, release of the upper latch dogs 42 has the consequence of releasing the connection module 20 from the connection sub 30.

FIG. 7 illustrates the downhole extraction of the gun and connection module 20 from the connection sub 30, which is an option after a wireline disconnect. Tension is drawn on the running tool 17 to release the upper latching dogs 42 from the latching windows 48. Once released, the tool line may be displaced in either direction. Consequently, the gun and connecting module assembly may be released by the running tool 17 and allowed to fall from the completion tube bore as indicated by FIG. 6. Conversely, the entire assembly may be drawn to the surface. If the gun has malfunctioned, the defect may be repaired or replaced and the assembly returned to the firing position without disturbing the remainder of the completion tube or any of the tools therein.

Return of the gun and connection module to the bottom-hole location following complete removal of the assembly from the wellbore requires a few minor modifications to the connection module 20. Essentially, such modifications include installation of a rupture disc 34 suitably calibrated for the depth of the latch channel 32. Additionally, the upper latching dog mechanism is expanded to radially retract the upper latching dogs 42. This expanded setting of the mechanism is temporarily secured by shear pins 59 between the latching dog elements 42 and the upper latch cone 44.

At the end of a wireline, the repaired or replaced perforating gun 24 and connection module 20 is lowered into the wellbore with the latching dogs 42 retracted as illustrated by FIGS. 2 and 8. At the predetermined depth (pressure), the pressure differential across the rupture disc 34 will exceed the disc capacity. This may occur as the hydrostatic head of the wellbore or as a consequence of external pressure from surface sources.

When the rupture disc 34 fails, wellbore pressure is admitted against the setting piston 36. This pressure on the piston 36 imposes shear stress on the calibrated pins 38 (FIG. 3). When the pins 38 fail, the resulting translation of the setting piston 36 defeats the pins 59 and allows the setting piston 36 to draw the upper latch cone 46 against the latching dogs 42. Such shear pin failure is followed by a translation of the setting piston 36.

Translation of the setting piston from the run-in position pulls the latch cone 44 against the shear pins 59. Failure of the shear pins 59 allows the slip face 49 of the latch cone 44 to be drawn under and radially displace the upper latch dogs 42. This hydrostatic pressure induced force on the dogs 42 is a standing bias that holds the latch dogs 42 against the inside borewall of this completion tube. When the assembly aligns with the latch channel 32 in the connection sub 30, the latching dogs 42 will mesh with the channel and secure the gun at the exact downhole location from which it was removed.

Although our invention has been described in terms of specified embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A method of well completion comprising the steps of:

(a) combining a first assembly including a well fluid production string having a production flow tubing, a well annulus packer and a well tool attachment profile within an internal flow bore of said tubing proximate of lower distal end of said tubing;

(b) combining a second assembly including an explosively actuated well perforating tool with a latching mechanism for selectively securing and releasing said second assembly relative to said attachment profile, said mechanism and perforating tool being dimensioned to freely traverse said tubing flow bore;

(c) combining a third assembly including said first and second assemblies;

(d) suspending said third assembly within a well;

(e) setting said annulus packer (f) activating said perforating tool to detonate explosive charges, said detonation releasing the second assembly from the first assembly.

2. A method of well completion as described by claim 1 wherein said second assembly is suspended from a surface opening of said well along and within said tubing flow bore.

3. A method of well completion as described by claim 2 wherein said second assembly is manipulated to release said mechanism from said tubing profile and extract said second assembly from said well along said flow bore.

4. A method of well completion as described by claim 3 wherein said second assembly is recombined with said first assembly by wireline.

5. A method of well completion as described by claim 4 wherein said latching mechanism is energized by wellbore pressure to engage said tubing profile.

6. A method of well completion as described by claim 1 wherein said second assembly is combined at a physical location remote from a situs of said well and transported as an assembly to said situs.

7. A method of well completion as described by claim 1 wherein said second assembly is combined with said first assembly in the proximity of said well.

8. A well completion assembly comprising:

(a) a first subassembly having a well fluid production tubing, a well annulus packer and a well tool attachment profile within an internal flow bore of said tubing proximate of a lower distal end of said tubing; and, (b) a second subassembly having an explosively actuated well perforation tool and a selectively engaged latching mechanism meshed with said tubing attachment profile, said perforating tool and said latching mechanism being dimensioned to traverse said tubing flow bore, and wherein the latching mechanism is responsive to an explosive discharge of said well perforation tool to release said second subassembly from said first subassembly.

9. A well completion assembly as described by claim 8 wherein said latching mechanism provides a compatible interface with a suspended connector for releasing said second subassembly from said first subassembly.

10. A method of perforating a well casing comprising the steps of:

a) securing a perforating gun to a connector module by means of a latch mechanism, said gun and connector module dimensioned to freely traverse a production tubing bore;

b) setting said latch mechanism at a first of at least two set positions, said first position for securing an anchor dog within a tubing bore detent profile;

c) securing said connector module and perforating gun to a production tubing string having a well annulus packer and a bore detent profile by meshing said anchor dog with said detent profile;

d) positioning an assembly of said gun, said connector module and said tubing string at a desired well depth;

e) setting said packer; and, f) discharging said perforating gun to release the latch mechanism from said first set position.

11. A method as described by claim 10 wherein combustion gas from said gun discharge is channeled to release said latch mechanism from said first set position and thereby release said anchor dog from the detent profile of said tubing string.

12. A method as described by claim 10 wherein said anchor dog may be released from said latch position by tension.

13. A method as described by claim 12 wherein a subassembly of said connector module and gun is removed from said tubing string.

14. A method as described by claim 10 wherein hydrostatic well pressure forces said anchor dog against said tubing string.

15. A method as described by claim 14 wherein said hydrostatic well pressure is applied against said anchor dog proximate of a predetermined depth of said anchor dog within said well.

* * * * *